US009153893B2

(12) United States Patent
Yamada et al.

(10) Patent No.: US 9,153,893 B2
(45) Date of Patent: Oct. 6, 2015

(54) TERMINAL BLOCK

(71) Applicant: Sumitomo Wiring Systems, Ltd., Yokkaichi, Mie (JP)

(72) Inventors: Hiroki Yamada, Yokkaichi (JP); Daisuke Akuta, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 59 days.

(21) Appl. No.: 14/071,991

(22) Filed: Nov. 5, 2013

(65) Prior Publication Data

US 2014/0134891 A1 May 15, 2014

(30) Foreign Application Priority Data

Nov. 13, 2012 (JP) ..... 2012-249567

(51) Int. Cl.

| | |
|---|---|
| ***H01R 13/42*** | (2006.01) |
| ***H01R 9/24*** | (2006.01) |
| ***H01R 43/18*** | (2006.01) |
| *H01R 4/34* | (2006.01) |
| *H01R 13/512* | (2006.01) |
| *H01R 107/00* | (2006.01) |

(52) U.S. Cl.

CPC ..... *H01R 13/42* (2013.01); *H01R 9/24* (2013.01); *H01R 43/18* (2013.01); *H01R 4/34* (2013.01); *H01R 13/512* (2013.01); *H01R 2107/00* (2013.01)

(58) Field of Classification Search

USPC ..... 439/722, 709, 86, 626, 660

See application file for complete search history.

(56) References Cited

U.S. PATENT DOCUMENTS

| | | | | |
|---|---|---|---|---|
| 3,937,550 | A * | 2/1976 | Gillemot | 439/603 |
| 7,955,141 | B2 * | 6/2011 | Jang et al. | 439/709 |
| 8,894,449 | B2 * | 11/2014 | Matsumoto et al. | 439/727 |
| 8,905,783 | B2 * | 12/2014 | Umemoto et al. | 439/587 |
| 2010/0297890 | A1 * | 11/2010 | Yang et al. | 439/660 |
| 2011/0117784 | A1 * | 5/2011 | Matsuoka et al. | 439/626 |
| 2011/0117792 | A1 * | 5/2011 | Kaneshiro | 439/709 |
| 2011/0130049 | A1 * | 6/2011 | Kaneshiro | 439/709 |
| 2012/0164867 | A1 * | 6/2012 | Matsumoto et al. | 439/345 |
| 2012/0186872 | A1 * | 7/2012 | Akuta | 174/70 B |
| 2012/0190232 | A1 * | 7/2012 | Akuta | 439/487 |
| 2012/0190251 | A1 * | 7/2012 | Akuta | 439/722 |
| 2012/0223601 | A1 * | 9/2012 | Akuta | 310/58 |
| 2012/0225593 | A1 * | 9/2012 | Akuta | 439/722 |
| 2013/0040473 | A1 * | 2/2013 | Tanaka et al. | 439/86 |
| 2013/0095704 | A1 * | 4/2013 | Awakura et al. | 439/709 |

FOREIGN PATENT DOCUMENTS

| | | |
|---|---|---|
| GB | 2490441 | 10/2012 |
| JP | 11-144783 | 5/1999 |

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A terminal block (10) connects terminals (T) at ends of wires extending from a motor and busbars (B) extending from an inverter and includes nuts (20) on which the terminals (T) and the busbars (B) are placed and which fasten the terminals (T) and the busbars (B) together with bolts (BT). A bracket (40) is arranged below the nuts (20), and a resin portion (50) integrally fixes the nuts (20) and the bracket (40). The bracket (40) includes a mounting portion (42) exposed from the resin portion (50) and is fixed to a metal motor case. An embedded portion (41) is embedded in the resin portion (50). The resin portion (50) includes first locks (57) for locking screw grooves (47A) of screw holes (47) on the mounting portion (42) from below, and a second lock (58) for locking an engaging portion 49 on the embedded portion (41) from below.

9 Claims, 18 Drawing Sheets

TERMINAL BLOCK

BACKGROUND

1. Field of the Invention

The invention relates to a terminal block.

2. Description of the Related Art

Japanese Unexamined Patent Publication No. H11-144783 discloses a terminal block for connecting a pair of terminals. This terminal block is configured so that the respective terminals are placed one over the other on a main body formed with a metal nut insert molded inside and electrically connected to each other by being fastened together by a bolt and the nut.

According to such a terminal block, heat generated from conductive members such as terminals is transferred to the nut and accumulated in the terminal block. Thus, it has been attempted to arrange a metal bracket fixed to a case of a motor below the nut via an insulating sheet, integrally fix these three members by a resin portion, transfer heat transferred from the conductive members to the nut to the bracket via the insulating sheet and radiate this heat from the bracket to the case of the motor.

Further, the bracket needs to be directly in contact with the case to radiate the heat from the bracket to the case, and it is necessary to reduce a covered part of the bracket by the resin portion. However, if the covered part of the bracket is small, the resin portion is pulled toward the bolt together with the nut and the resin portion and the bracket are separated at the time of bolt tightening.

The invention was completed in view of the above situation and an object thereof is to prevent the separation of a bracket and a resin portion while improving a heat radiation property of the bracket.

SUMMARY OF THE INVENTION

The invention relates to a terminal block for connecting a conductive member extending from a device and a mating conductive member. The terminal block includes a fastening seat on which the conductive member and the mating conductive member are placed. A bolt fastens the fastening seat, the conductive member and the mating conductive member together with a bolt. A metal bracket is adjacent to the fastening seat and a resin portion covers a part of the fastening seat and the bracket to fix the fastening seat integrally with the bracket. The bracket has at least one mounting portion exposed from the resin portion and fixed to a metal case for housing the device and at least one embedded portion embedded in the resin portion. The resin portion includes a first locking portion for locking a first engaging portion on the mounting portion and a second locking portion for locking a second engaging portion on the embedded portion.

Heat of the bracket of the above-described terminal block can be radiated to the metal case from the mounting portion directly fixed to the metal case. There is concern that the resin portion will be pulled up with the fastening seat as the bolt is tightened into the fastening seat and that the bracket fixed to the case may be separated from the resin portion. However, the second locking portion of the resin portion locks the second engaging portion of the embedded portion from below. Therefore, the bracket and the resin portion cannot separate at the embedded portion side.

The first engaging portion of the mounting portion is locked from below by the first locking portion of the resin portion. Thus, the bracket cannot separate from the resin portion at the mounting portion side and heat radiation from the bracket to the case is improved.

The fastening seats are arranged substantially in a width direction intersecting an extending direction of the conductive member.

The resin portion preferably includes nut locking portions for locking outer peripheral edges of the fastening seats. At least one partition wall is provided between adjacent nut locking portions for partitioning between adjacent fastening seats.

The first locking portion preferably is on an end of the partition wall.

According to such a configuration, one first locking portion supports two adjacent nut locking portions to prevent separation of the bracket and the resin portion. Thus, the structure of the mounting portion is simplified by reducing the number of the first locking portions as compared with providing a first locking portion for each nut locking portion.

The lower surface of the mounting portion fixed to the case is recessed up to form at least one heat radiation recess for radiating heat of the bracket by taking in coolant for cooling the interior of the case.

The first engaging portion may be formed by cutting a built-up portion above the heat radiation recess.

An attempt could be made to form the first engaging portion above the heat radiation recess by cutting without providing the mounting portion with the built-up portion. This approach would cause a side of the mounting portion above the heat radiation recess to become thinner, and, thus, the first engaging portion could not be formed. However, the invention forms the first engaging portion by cutting the build-up portion on top of the mounting portion. Thus, the heat radiation recess and the first engaging portion can be provided vertically one above the other on the mounting portion. This approach prevents enlarging the mounting portion as compared with the case where the mounting portion and the heat radiation recess are formed without being arranged one above the other.

The first engaging portion may comprise a screw hole including a screw groove on an inner peripheral surface. Thus, the first locking portion of the resin portion can firmly lock the screw groove.

A plurality of the first engaging portions may be arranged in a width direction intersecting an extending direction of the conductive member. The first engaging portions may include cuts arranged to coincide in a width direction. The cuts can be formed in each of the first engaging portions by cutting the mounting portion in the width direction using a cutting tool. This can simplify a cutting process as compared with the case where the mounting portion is cut to individually form the cuts, for example, using a drill.

These and other features and advantages of the invention will become more apparent upon reading the following detailed description of preferred embodiments and accompanying drawings. It should be understood that even though embodiments are described separately, single features may be combined to additional embodiments.

DETAILED DESCRIPTION OF THE PREFERRED EMBODIMENTS

A first embodiment of the invention is illustrated in FIGS. 1 to 15 and includes a terminal block 10 that is to be mounted to a mounting device such as a motor case (not shown) made of conductive material (e.g. metal) and installed in a vehicle such as an electric vehicle or a hybrid vehicle. The terminal block 10 electrically connects terminals T and busbars B. The terminals T are connected to enameled wires (not shown) extending from a connection device, e.g. extending from a three-phase AC motor housed in the motor case. The busbars B extend from the connection device, e.g. from an inverter. Note that, in the following description, a vertical direction is based on that in FIG. 2, forward and backward directions are based on a vertical direction of FIG. 9, and a side where the busbars B are arranged (shown upper side) is referred to as a front side.

Figure 10:
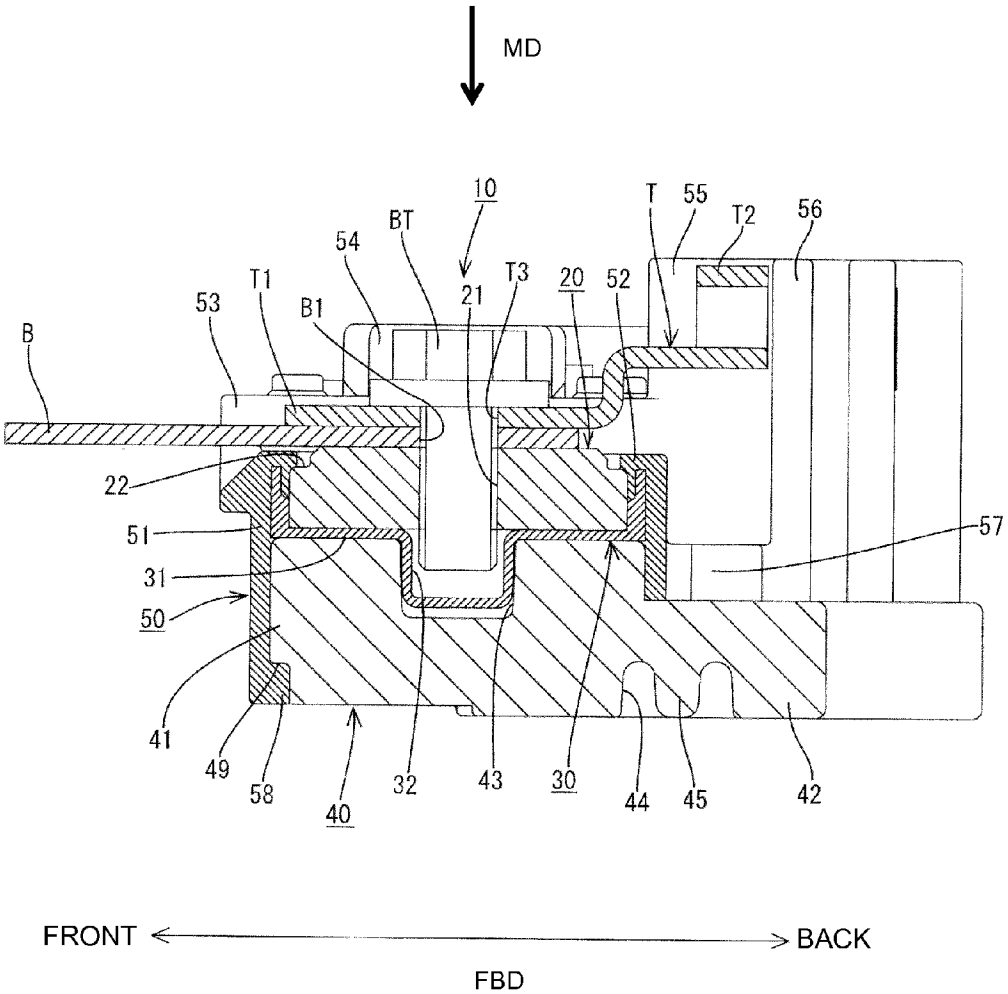
FIG. 10 is a section along X-X of FIG. 9.
Figure 11:
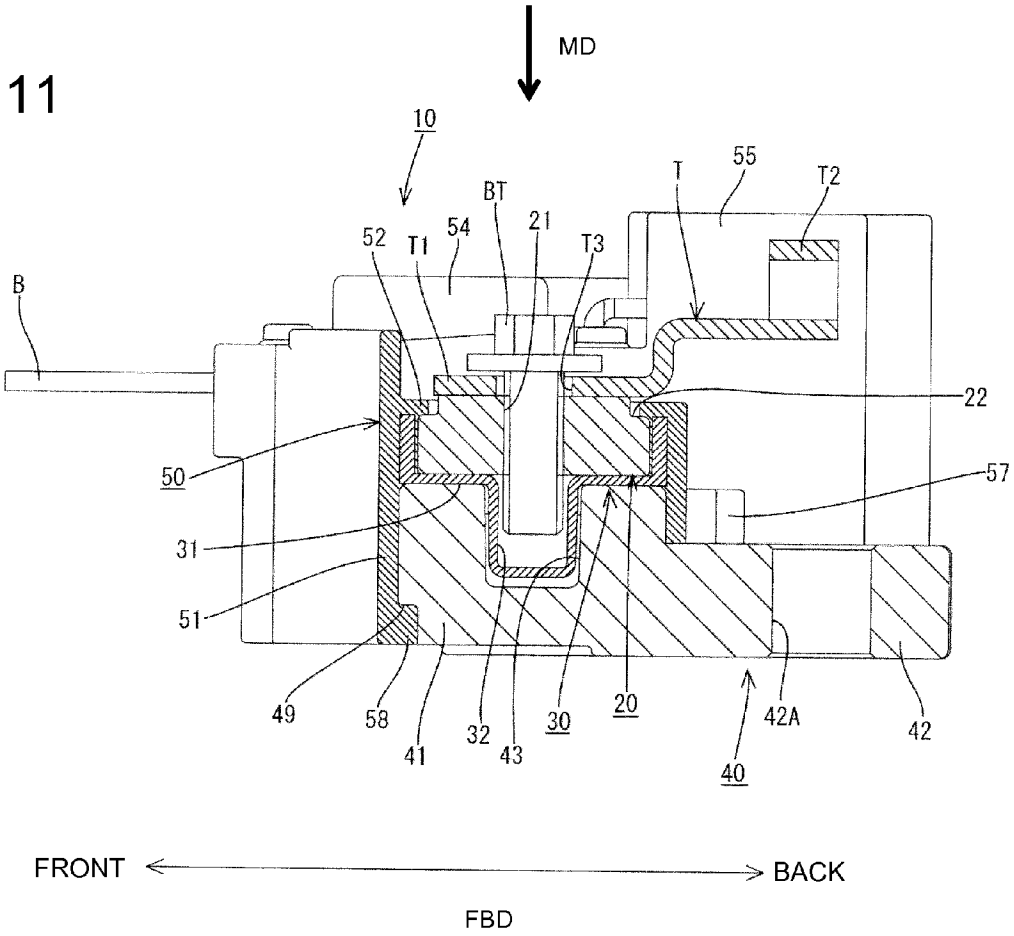
FIG. 11 is a section along XI-XI of FIG. 9.
Figure 12:
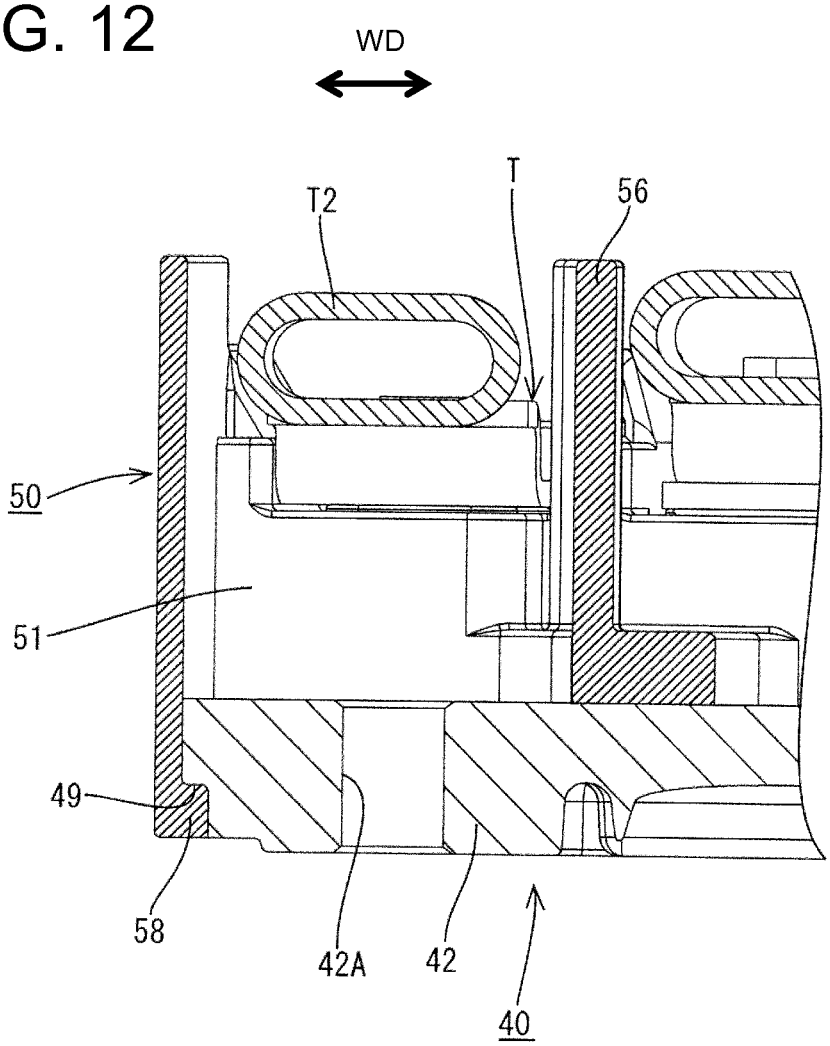
FIG. 12 is a section along XII-XII of FIG. 9.

As shown in FIGS. 10 and 11, the terminal block 10 has nuts 20 on which the busbars B and the terminals T are to be placed in a mounting direction MD (e.g. from above), a bracket 40 below the nuts 20, an insulating plate 30 between the nuts 20 and the bracket 40, and a resin portion 50 for integrally fixing these.

The busbar B is a substantially flat plate that vertically penetrates the bolt insertion hole B1 in the mounting direction MD at a position to be placed on the nut 20.

Figure 8:
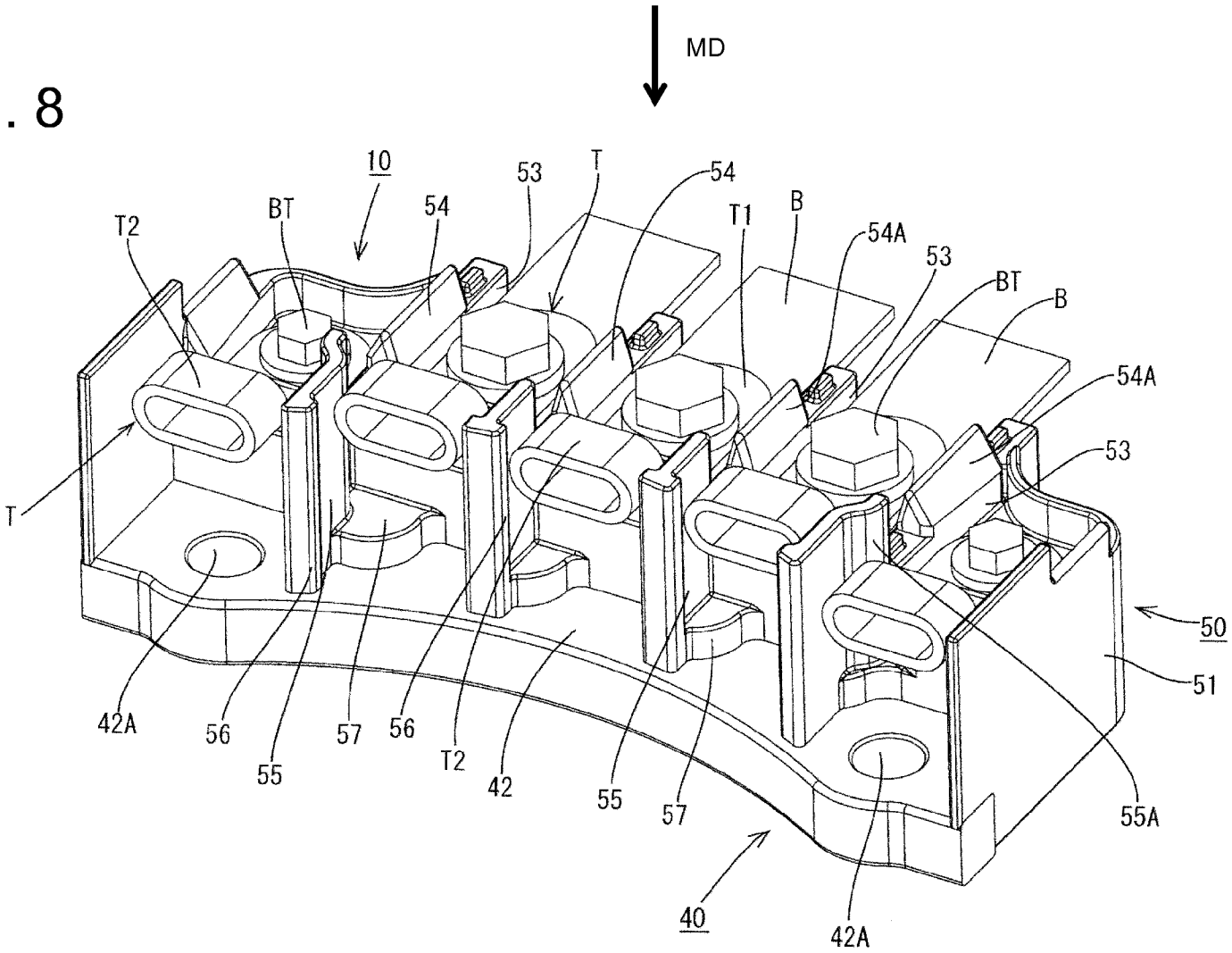
FIG. 8 is a perspective view showing a state where busbars and terminals are bolted in proper postures.
Figure 9:
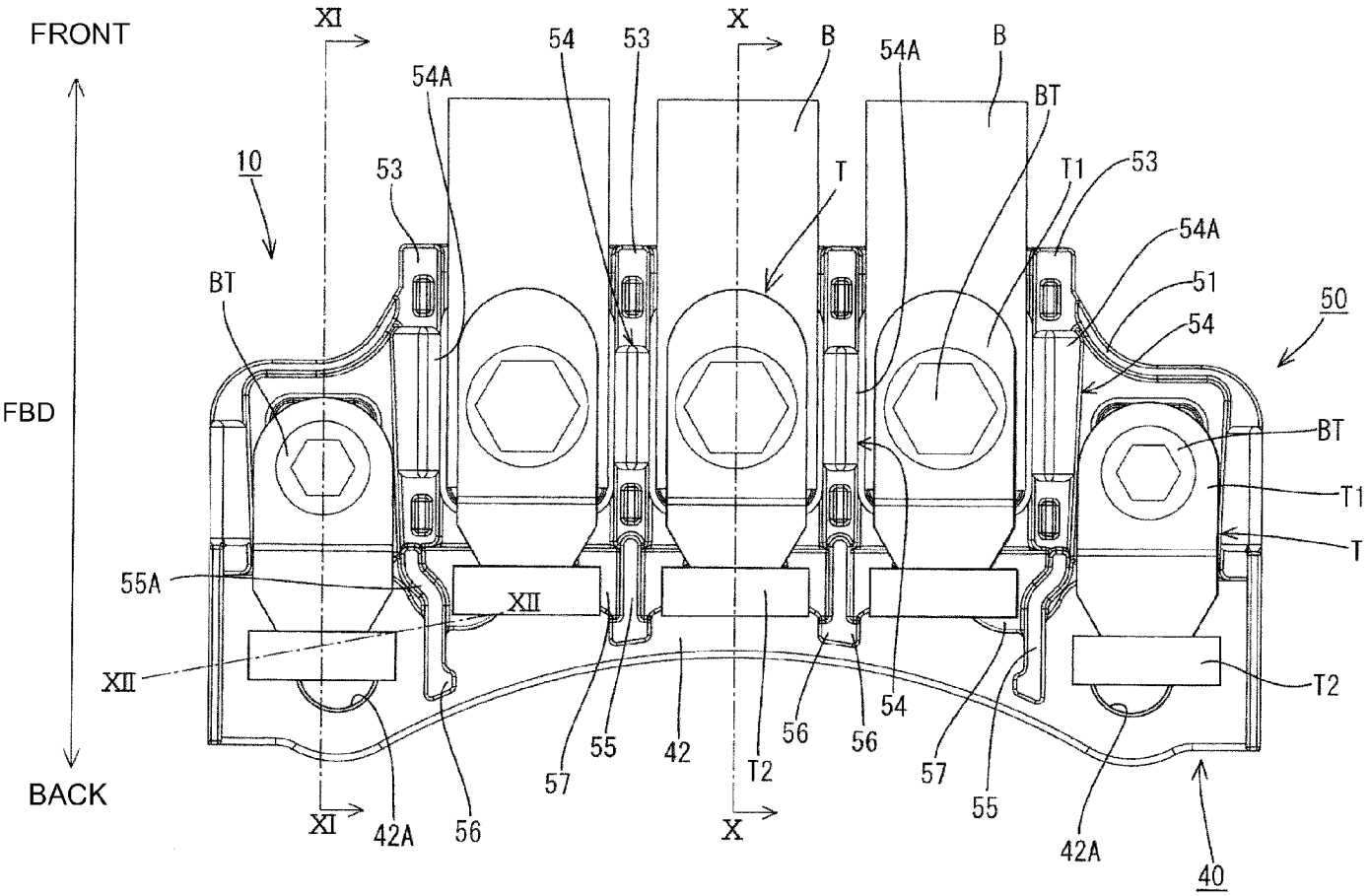
FIG. 9 is a plan view showing the state of FIG. 8.

As shown in FIGS. 8 to 10, the terminal T includes a bolt fastening portion T1 in the form of a flat plate to be placed on the nut 20 and a barrel T2 to which enameled wires are to be connected. A connecting part is between the bolt fastening portion T1 and the barrel T2 and is cranked so that the barrel T2 is offset from the bolt fastening portion T1. The bolt fastening portion T1 is formed with a vertically penetrating bolt insertion hole T3. Further, the barrel T2 particularly is in the form of a substantially elliptical tube that is wide in the width direction WD, and substantially opposite widthwise end parts are rounded.

Figure 3:
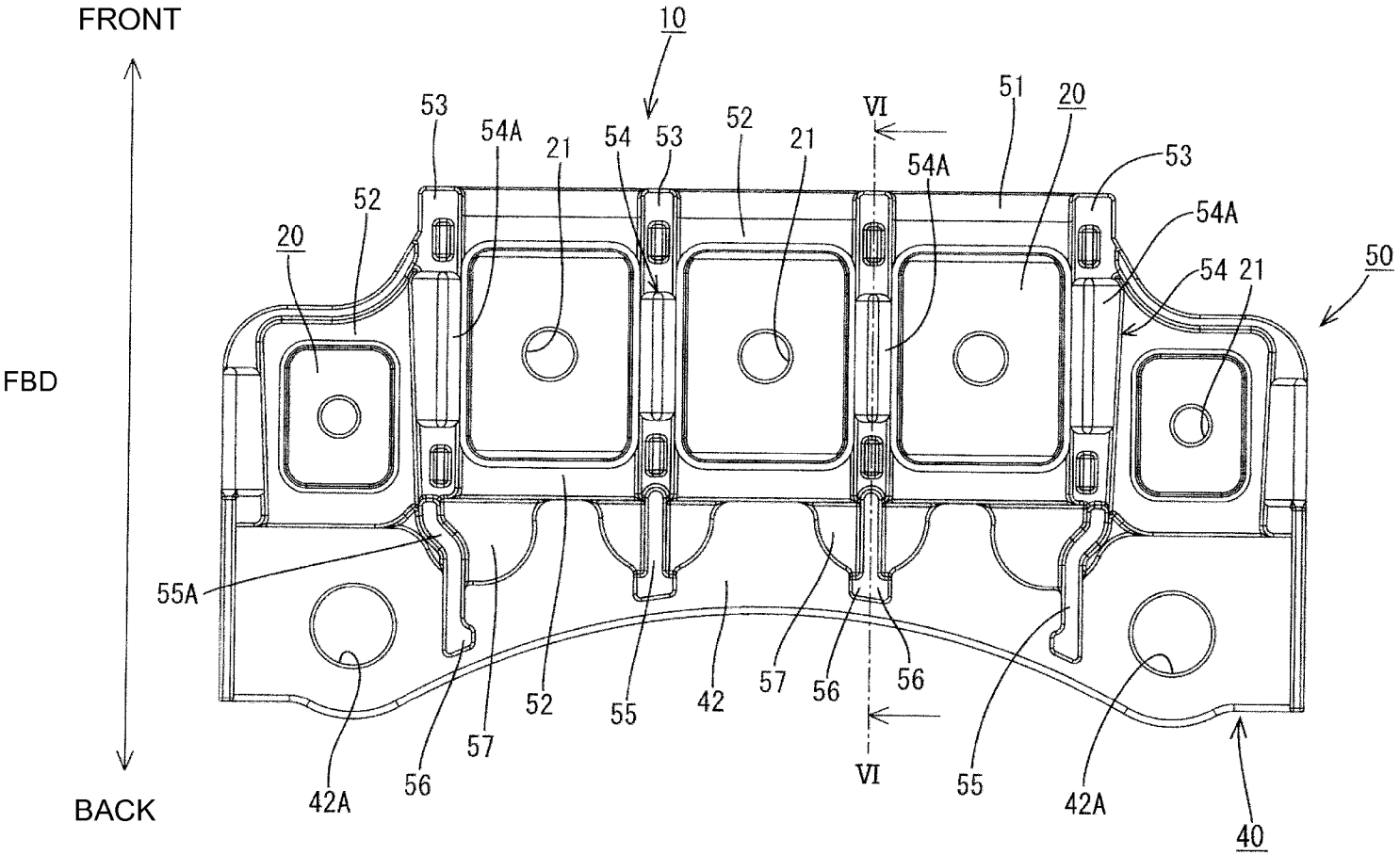
FIG. 3 is a plan view of the terminal block.

Each nut 20 is made of conductive material such as metal and, as shown in FIG. 3, has a substantially rectangular plan view. A bolt fastening hole 21 is provided in a central part of each nut 20 and a bolt BT can be tightened therein. The nuts 20 are arranged in the width direction WD. The bolt fastening portion T1 of the terminal T for power source and the busbar B are placed one over the other on each of the three middle nuts 20. The bolt BT is inserted through the bolt fastening hole T3 of the bolt fastening portion T1 and the bolt insertion hole B1 of the busbar B and tightened into the bolt fastening hole 21 of the nut 20 so that the terminal T and the busbar B are fastened together and electrically connected by the bolt BT and the nut 20, as shown in FIG. 10.

The bolt fastening portion T1 of the terminal T for neutral point is placed on each of the nuts 20 on the opposite sides from above, the bolt BT is inserted through the bolt insertion hole T3 of the bolt fastening portion T1 and tightened into the bolt fastening hole 21 of the nut 20 so that the terminal T for neutral point is bolted to the nut 20 as shown in FIG. 11.

The barrel T2 of the terminal T is behind or offset from the nut 20 when the bolt fastening portion T1 of each terminal T is fixed to the nut 20.

A step 22 is formed over substantially the entire periphery on an upper peripheral edge of each nut 20. As shown in FIGS. 10 and 11, this step 22 is slightly lower than the upper surface of the nut 20 and is covered at least partly by a nut locking portion 52 of the resin 50 from above.

The insulating plate 30 is made of a highly heat conductive synthetic resin containing glass or talc and is sandwiched vertically by the nuts 20 and the bracket 40, as shown in FIGS. 10 and 11. A bottom plate 31 is arranged between the nuts 20 and the bracket 40 and is in the form of a thin flat plate. The lower surfaces of the nuts 20 are held in close contact with the upper surface of the bottom plate 31, and the upper surface of the bracket 40 is held in close contact with the lower surface of the bottom plate 31. Thus, heat of the nuts 20 is transferred efficiently to the bracket 40 via the insulating plate 30.

The bottom plate 31 of the insulating plate 30 has bolt escaping recesses 32, which are bottomed recesses that project down. Each bolt escaping recess 32 substantially corresponds to the bolt fastening hole 21 of the nut 20 arranged on the upper surface of the insulating plate 30, and prevents interference of the bolt BT and the insulating plate 30 by allowing the tip of the bolt BT to escape when the bolt BT is tightened into the nut 20.

Figure 14:
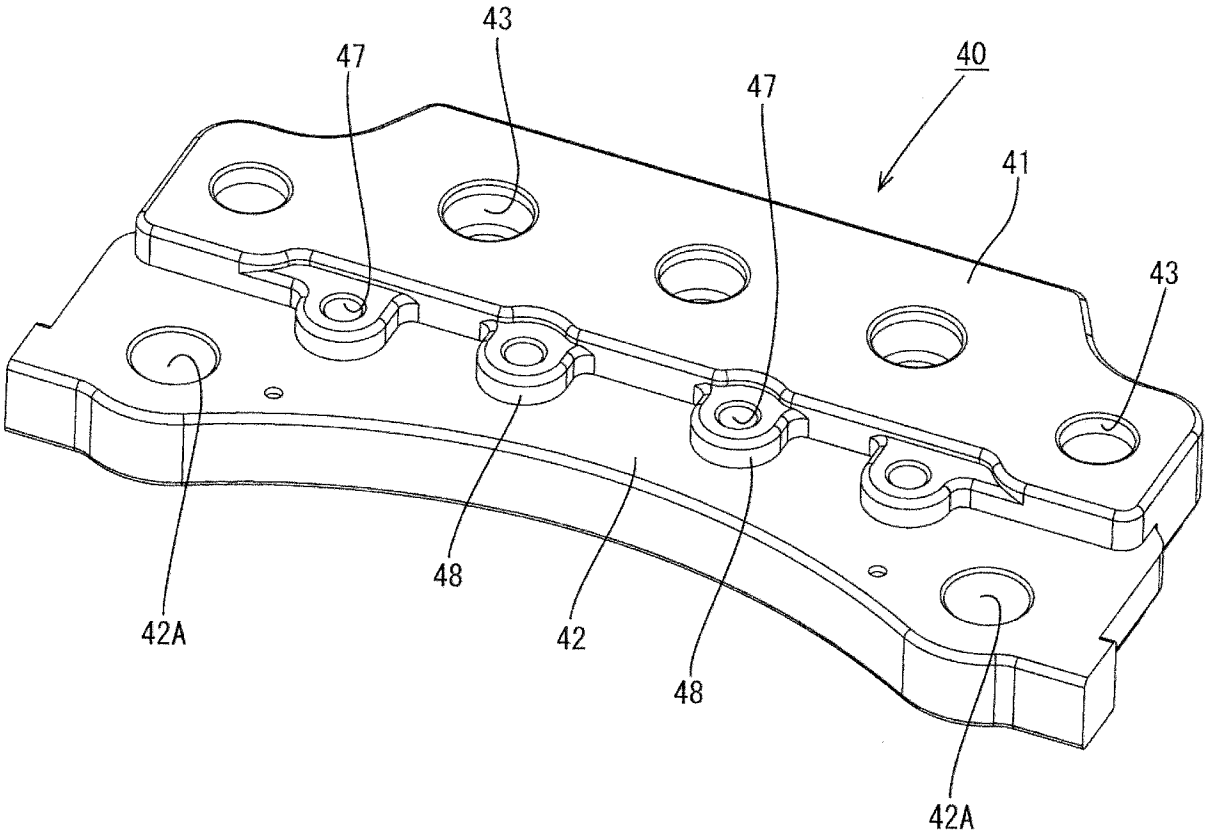
FIG. 14 is a perspective view of a bracket.
Figure 15:
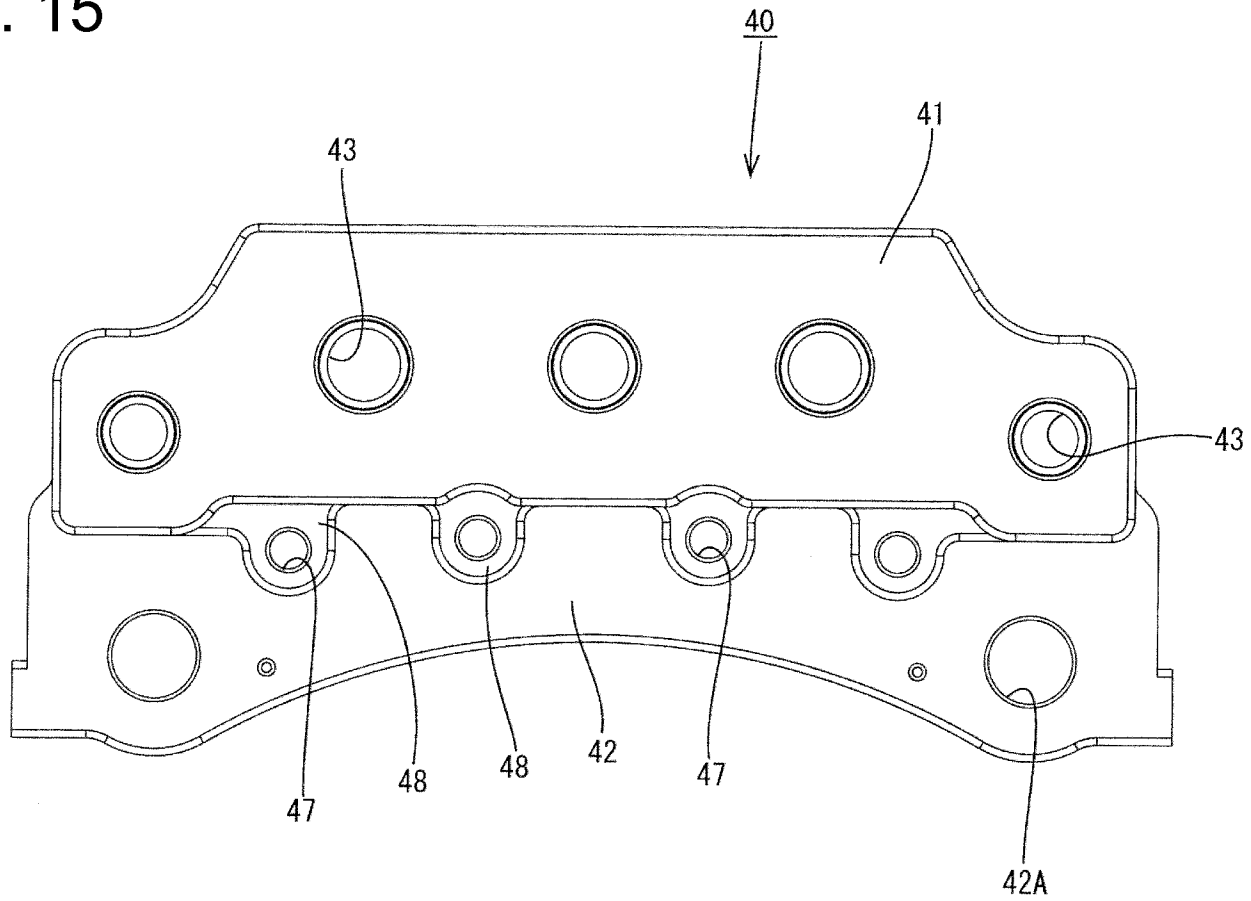
FIG. 15 is a plan view of the bracket.

The bracket 40 is formed by aluminum die casting and, as shown in FIGS. 14 and 15, wide in the width direction WD. The rear surface of the bracket 40 is formed into a substantially arcuate or bent shape substantially in conformity with the shape of the motor case. As shown in FIGS. 10 and 11, the bracket 40 includes an embedded portion 41 on which the insulating plate 30 is to be placed and that is covered by the resin 50. A mounting portion 42 is connected behind the embedded portion 41 and is exposed from the resin portion 50.

The insulating plate 30 is placed on the upper or outer surface of the embedded portion 41 and covers substantially the entire upper surface of the embedded portion 41. Fitting recesses 43 are provided substantially side by side in the width direction WD on the upper surface of the embedded portion 41 and receive the bolt escaping recesses 32 of the insulating plate 30. The insulating plate 30 is to be mounted on the upper surface of the embedded portion 41 without being displaced by fitting the bolt escaping recesses 32 into the fitting recesses 43.

As shown in FIGS. 10 and 15, the mounting portion 42 is provided on a lower rear end edge of the embedded portion 41 and is to be fixed to an attaching portion (not shown) on the motor case. As shown in FIG. 3, through holes 42A vertically penetrate opposite widthwise sides of the mounting portion 42. Fixing bolts (not shown) are inserted through the through holes 42A and tightened into the attaching portion to fix the bracket 40 and the terminal block 10 to the motor case.

Figure 5:
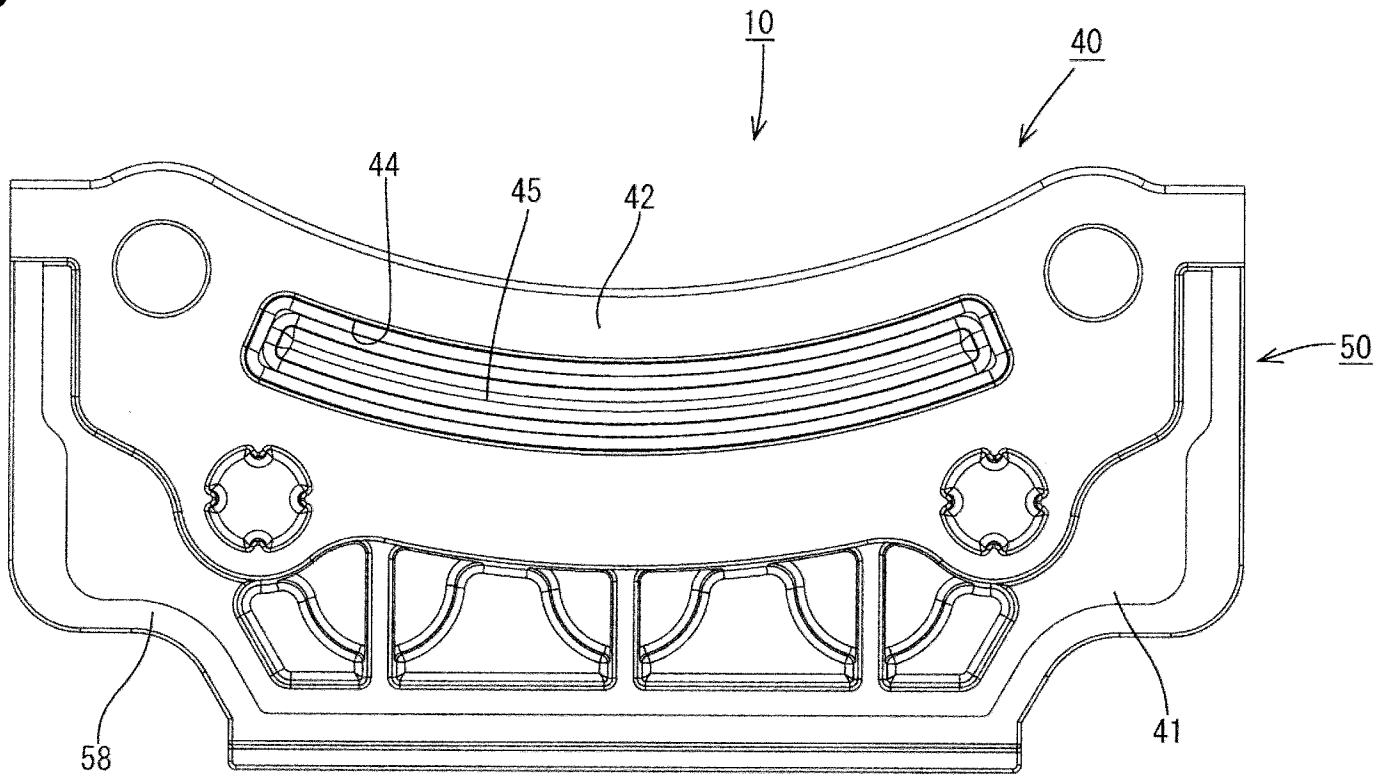
FIG. 5 is a bottom view of the terminal block.
Figure 6:
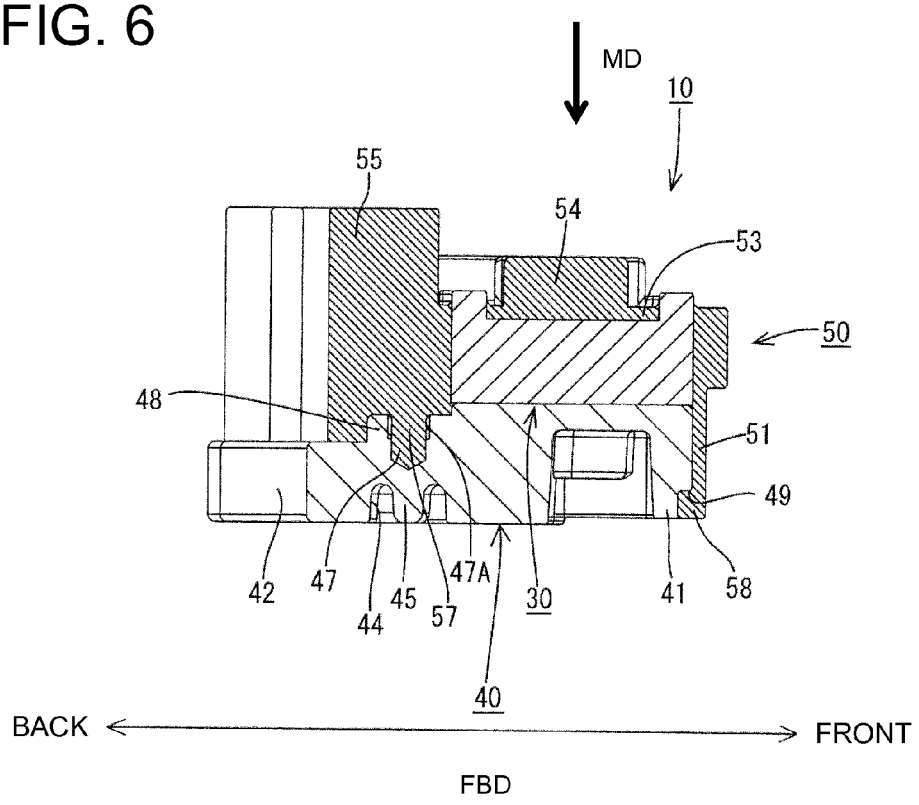
FIG. 6 is a section along VI-VI of FIG. 3.

As shown in FIGS. 5 and 6, at least one arcuate heat radiation recess 44 is formed on the lower surface of the mounting portion 42 and extends in the width direction WD. The heat radiation recess 44 is recessed up and at least one cooling fin 45 projects down near the back wall of the heat radiation recess 44. When the mounting portion 42 is fixed to the attaching portion of the motor case, coolant circulating in the motor case can circulate substantially in the width direction WD in the heat radiation recess 44 and heat of the bracket 40 is efficiently radiated from the cooling fin 45.

A substantially rectangular gate mark 46 is formed on the rear surface of the mounting portion 42 when a molding die is opened (see FIG. 2) and defines a fracture mark of an aluminum die casting material. Although not shown, find edges formed when the aluminum die casting material is fractured maybe left on an outer peripheral edge of the gate mark 46 in some cases.

The resin portion 50 is made of synthetic resin and, as shown in FIGS. 10 and 11, integrally fixes the nuts 20, the insulating plate 30 and the bracket 40 while vertically holding them one over another in close contact by at least partly covering parts of these members. The resin portion 50 includes a main body 51 that collectively covers side surfaces of the nuts 20, of the insulating plate 30 and of the embedded portion 41.

A substantially rectangular nut locking portion 52 is provided on an upper part of the main body 51 and locks the step 22 of each nut 20 together with the insulating plate 30. The nut locking portion 52 locks the step 22 of each nut 20 from above to prevent a clearance from being formed between the nut 20 and the insulating plate 30 when the bolt BT is tightened into the bolt fastening hole 21 of the nut 20 and the nut 20 is pulled up.

Figure 4:
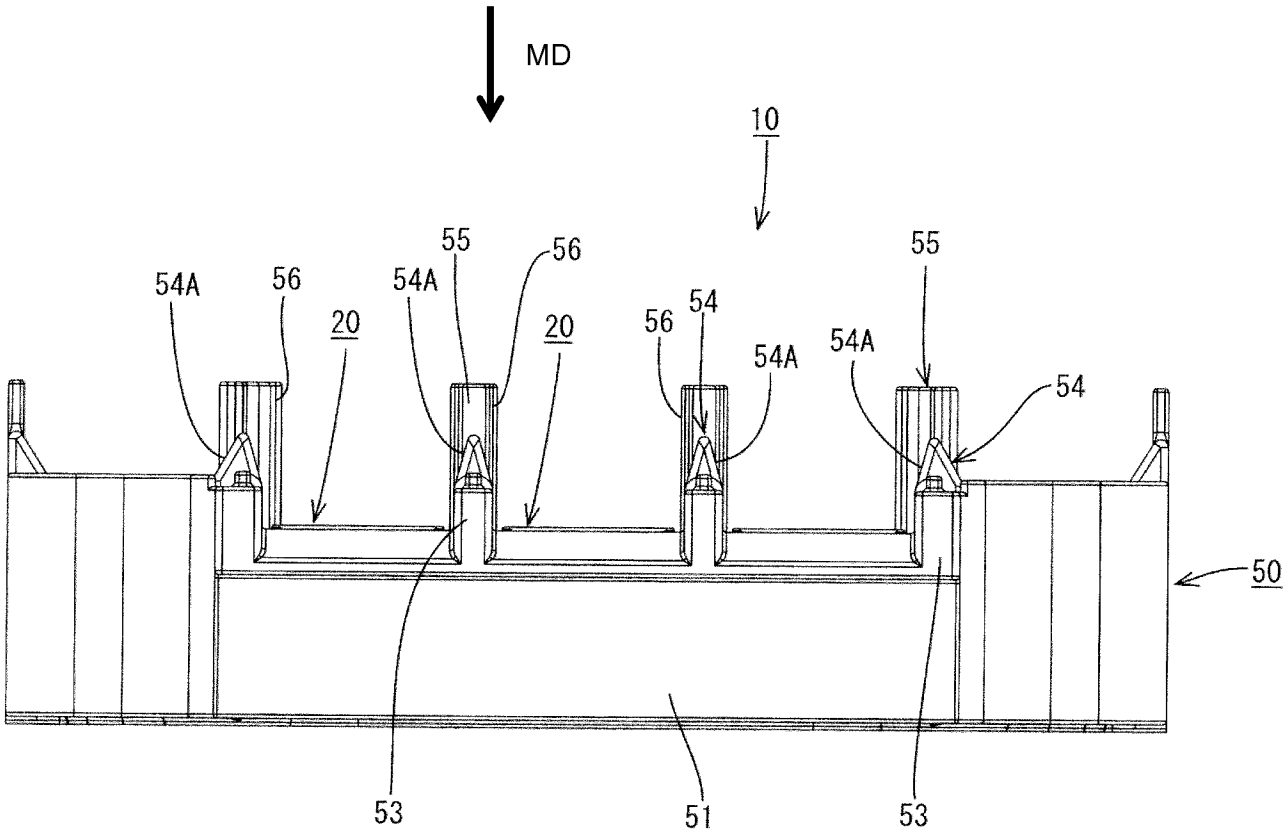
FIG. 4 is a rear view of the terminal block.

As shown in FIGS. 3 and 4, partition walls 53 stand up from the main body 51 at positions between adjacent nut locking portions 52 and partition adjacent nuts 20. Specifically, the partition walls 53 are arranged substantially side by side in the width direction WD and extend over the entire length of the main body portion 51 in forward and backward directions FBD. The height of the partition wall 53 exceeds the sum of the thickness of the bolt fastening portion T1 of the terminal T and the thickness of the busbar B placed on the nut 20, as shown in FIG. 10. Thus, a distance at which insulation is maintained between adjacent bolt fastening portions T1 and between adjacent busbars B is assured, i.e. a so-called insulation distance (creepage distance).

A guide 54 is provided of an upper end of each partition wall 53 at an intermediate part in forward and backward directions FBD, as shown in FIGS. 3 and 4, and guides the busbar B and the terminal T with respect to the upper surface of the nut 20. The guide 54 has a converging or pointed triangular shape that is long in forward and backward directions FBD and has oblique surfaces 54A on opposite widthwise sides. Thus, the busbar B and the bolt fastening portion T1 contact the oblique surfaces 54A of the guides 54 and are guided onto the upper surface of the nut 20 even if the busbar B and/or the bolt fastening portion T1 of the terminal T are displaced slightly in the width direction WD when placing the busbar B and the terminal T on the upper surface of the nut 20 in the mounting direction MD.

Figure 1:
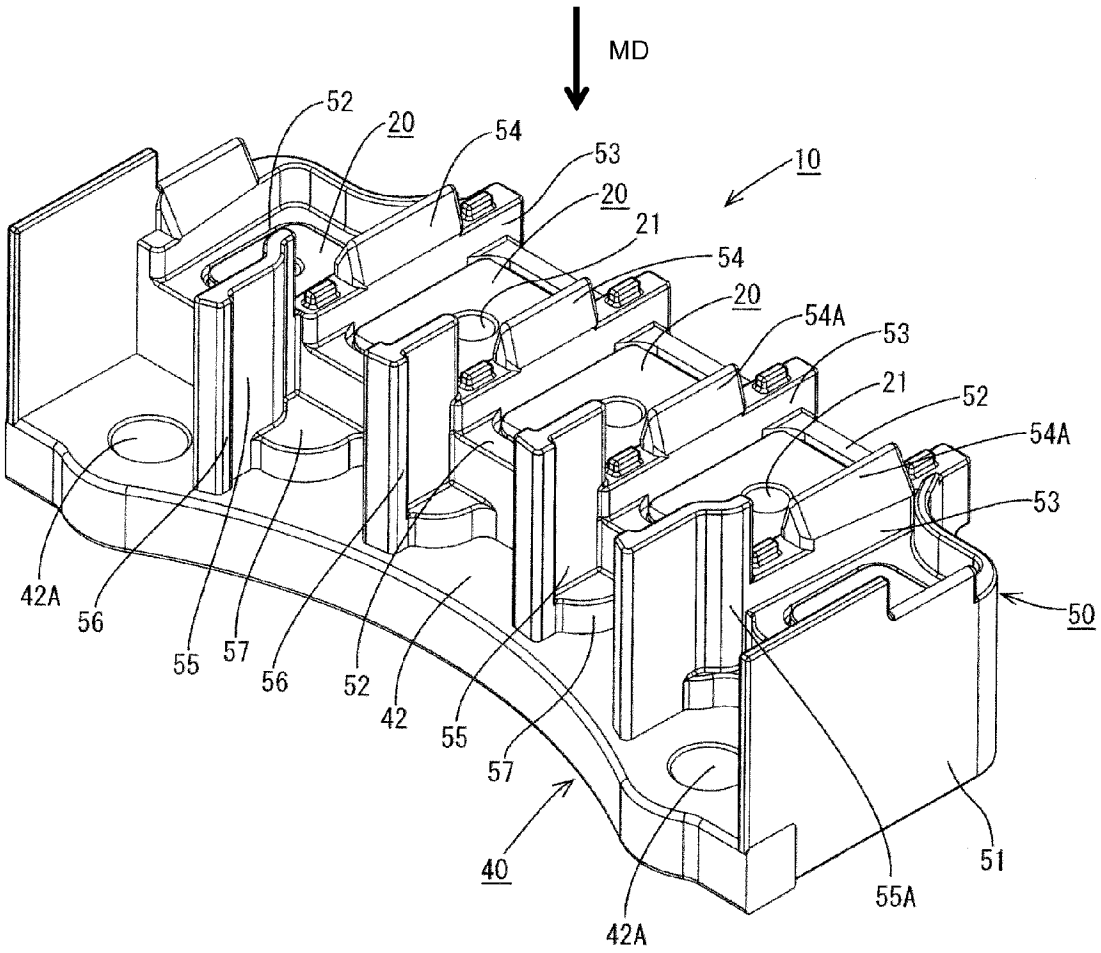
FIG. 1 is a perspective view of a terminal block in a first embodiment.
Figure 2:
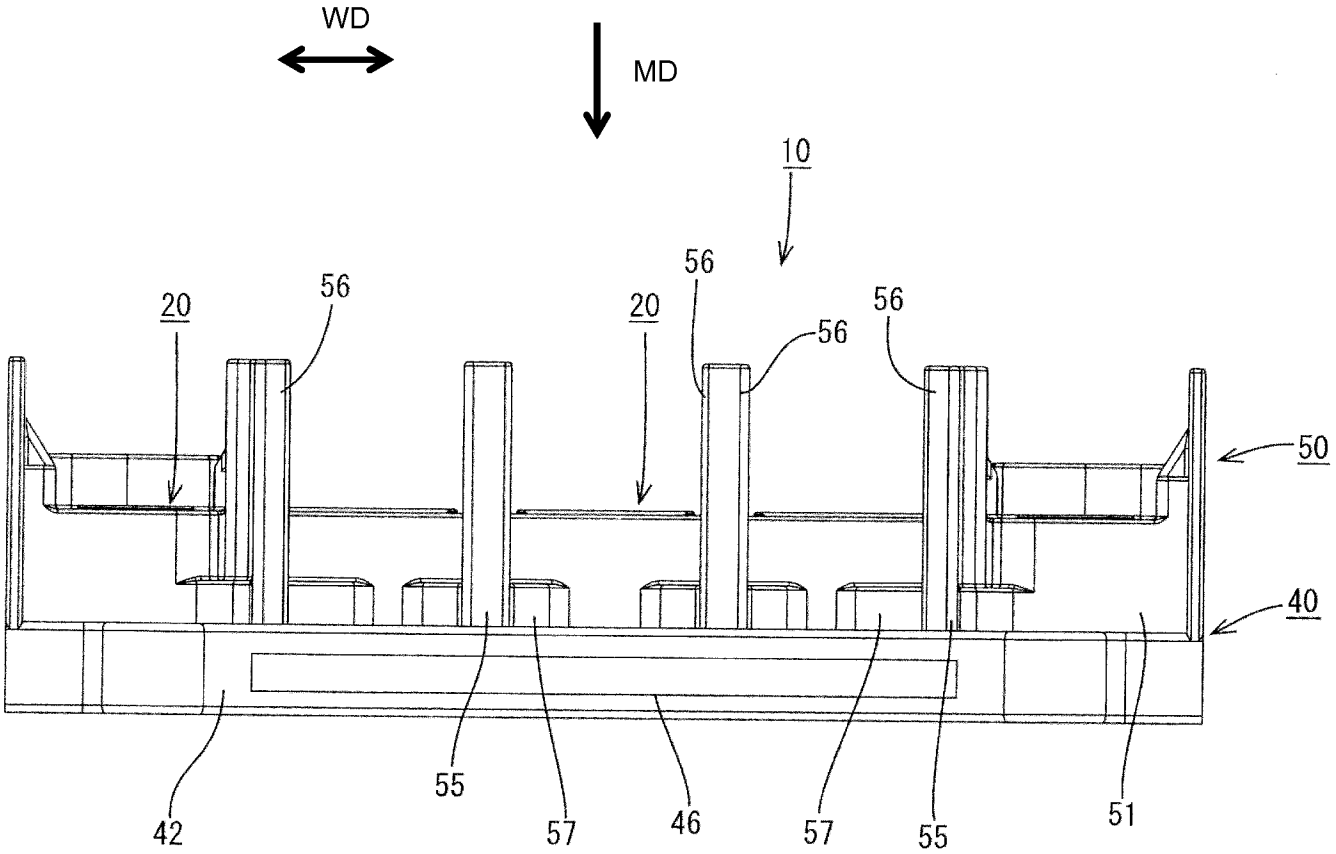
FIG. 2 is a front view of the terminal block.

As shown in FIGS. 1 and 3, a substantially plate-like posture correcting portion 55 extends back from the rear end of each partition wall 53. The posture correcting portions 55 project up along the mounting direction MD from the upper surface of the mounting portion 42. The posture correcting portions 55 on opposite widthwise sides meander in the width direction WD at positions near the partition walls 53 as shown in FIG. 3, thereby forming crank portions 55A bent toward the center.

As shown in FIG. 9, the barrels T2 of the terminals T placed on the nuts 20 are arranged at opposite widthwise sides of the posture correcting portions 55 with clearances defined in the width direction WD therebetween. As shown in FIGS. 10 and 11, the height of the posture correcting portion 55 exceeds the height of the barrel T2 located on a rear part of the terminal T, and a rear end part thereof extends more backward than the rear part of the barrel T2. When the terminals T are placed on the nuts 20, the posture correcting portions 55 block between the barrels T2 of adjacent terminals T to ensure a creepage distance (insulation distance) between adjacent barrels T2.

Figure 13:
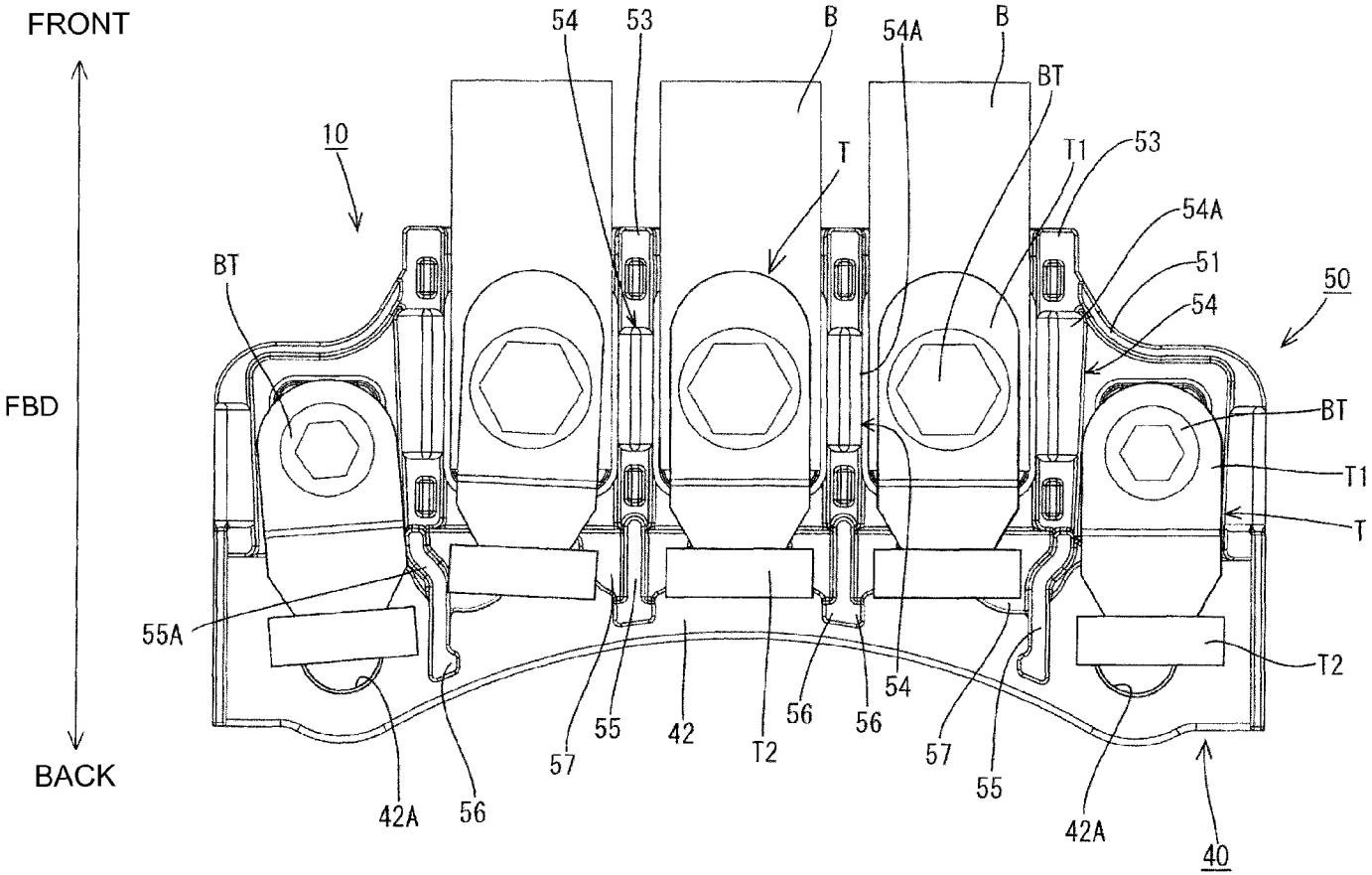
FIG. 13 is a perspective view showing a state where the busbar and the rotated terminal are bolted.

Further, if the terminal T is placed on the nut 20 from above and in the mounting direction MD with the barrel T2 thereof displaced in the width direction WD, the posture correcting portion 55 contacts a lateral edge of the barrel T2 in the width direction and corrects the posture of the barrel T2 in the width direction WD to a substantially proper posture in which the terminal T is straight in forward and backward directions FBD. When the terminals T are placed on the nuts 20, the adjacent barrel portions T2 are blocked by the posture correcting portions 55 and the creepage distance (insulation distance) between the barrels T2 is ensured even if the adjacent barrels T2 are displaced slightly in the width direction WD, as shown in FIG. 13.

The terminal T may rotate following the rotation of the bolt BT when tightening the bolt BT into the nut 20. However, the posture correcting portion 55 contacts the barrel T2 in the width direction WD to limit rotation of the terminal T and ensuring the creepage distance (insulation distance) between the adjacent barrels T2.

At least one projection 56 project substantially in the width direction WD on a rear end part of each posture correcting portion 55 for reinforcement. The projection 56 is formed over the entire height of the posture correcting portion 55 and is behind the barrel T2 of the terminal T mounted in a proper posture on the nut 20.

Projections 56 is provided on each of opposite widthwise sides of each of the two posture correcting portions 55 arranged in the intermediate position out of the posture correcting portions 55 to prevent the posture correcting portion 55 from being inclined in the width direction WD and broken when a lateral force acts on the posture correcting portion 55. Further, one projection 56 is provided on each of the two posture correcting portions 55 arranged on opposite widthwise sides and projects toward the center to cooperate with the crank portion 55A to reinforce the posture correcting portion 55. Thus, the two posture correcting portions 55 arranged on the opposite widthwise sides prevent the posture correcting portions 55 from being inclined in the width direction WD to be broken when a lateral force acts on the posture correcting portions 55.

The strength of the posture correcting portion in the width direction WD could be increased by setting the thickness of the entire posture correcting portion to the thickness of the part where the projecting portions are provided. However, if the thickness of the entire posture correcting portion is increased, the clearance between the posture correcting portion and the barrel becomes smaller. Even a slight displacement of the terminal T in the width direction WD may cause the barrel T2 to move onto the posture correcting portion when placing the nut 20 on the terminal T. However, the clearance between the posture correcting portion 55 and the barrel T2 is made larger by thinning the posture correcting portion 55 except at the part where the projections 56. Thus the barrel T2 easily can be arranged between the posture correcting portions 55 even if the terminal T is displaced slightly in the width direction WD when being placed on the nut 20. This can improve mounting operability in placing the terminal T on the nut 20.

The creepage distance between the barrels of adjacent terminals T may become shorter if the bolt insertion hole T3 of the bolt fastening portion T1 is large relative to the bolt BT and the terminal T is bolted in a state slightly displaced backward. However, if the terminal T is displaced backward, the projecting portions 56 contact the barrel T2 in the width direction WD and the posture of the terminal T can be corrected to approach a proper posture where the terminal T is substantially straight in forward and backward directions FBD. Thus, the required creepage distance (insulation distance) between the barrels T2 is assured.

The projection 56 has two functions, namely, reinforcing the posture correcting portion 55 and correcting the posture of the terminal T. Thus, the structure of the posture correcting portion 55 becomes less complicated, as compared with the case where the reinforcing function and the posture correcting function are provide separately.

A first lock 57 is provided on a lower end part of the posture correcting portion 55 and engages a bottomed screw hole 47 provided on the mounting portion 42.

The screw hole 47 of the mounting portion 42 has a screw groove 47A on the inner peripheral surface and is formed by recessing the upper surface of a substantially cylindrical build-up portion 48 projecting from the upper surface of the mounting portion 42.

Figure 7:
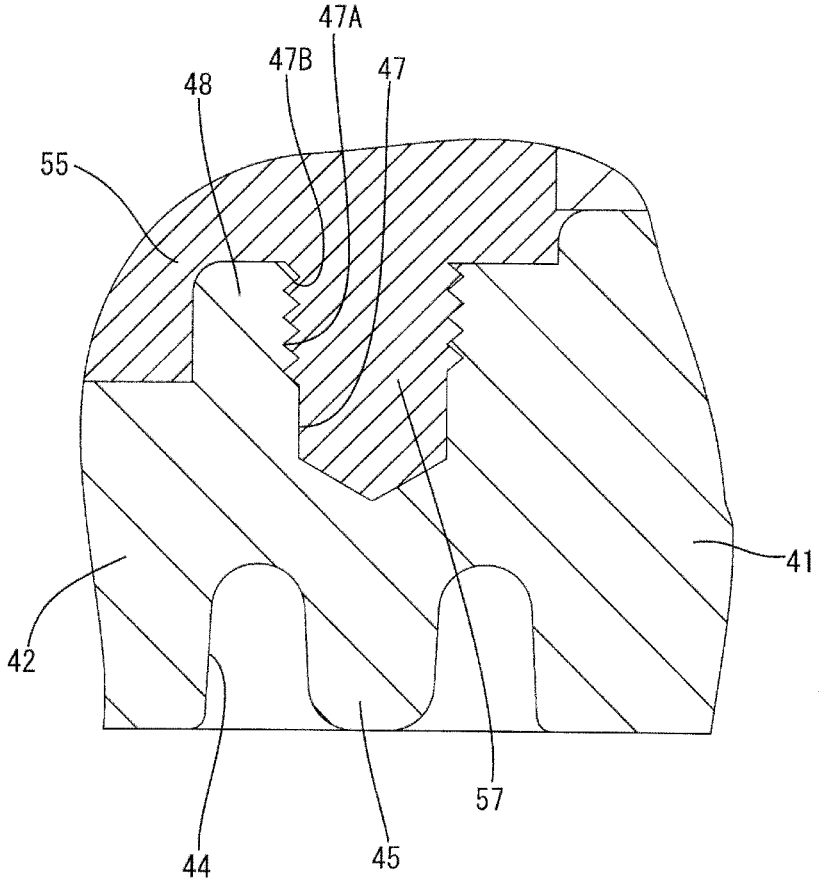
FIG. 7 is an enlarged section of an essential part of FIG. 6.

As shown in FIG. 7, the first lock 57 enters the screw hole 47 of the mounting portion 42 and the screw groove 47A of the screw hole 47 by covering the build-up portion 48 of the mounting portion 42. The first lock 57 locks an upper end 47B of the screw groove 47A from below when an upward pulling force acts on the resin portion 50. Thus, the main body 51 of the resin portion 50 and the embedded portion 41 of the bracket 40 cannot be separated at a rear end of the resin portion 50 when the bolt BT is tightened into the bolt fastening hole 21 of the nut 20 and the resin portion 50 is pulled up together with the nut 20.

Further, the first locking portions 57 and the screw holes 47 particularly are arranged substantially between adjacent nut locking portions 52, and two nut locking portions 52 are supported by one first locking portion 57 and one screw hole 47. That is, e.g. five nut locking portions 52 are supported by four first locking portions 57 and e.g. four screw holes 47 on the rear end side of the resin portion 50 and the numbers of the first locking portions 57 and the screw holes 47 can be reduced as compared with the case where the first locking portion is formed for each nut locking portion. This can prevent the bracket 40 and the resin portion 50 from being separated while simplifying the structure of the rear end side of the resin portion 50.

The screw holes 47 are arranged in correspondence with and above the heat radiation recess 44 of the mounting portion 42 and formed in the build-up portions 48 on top of the mounting portion 42 so that a sufficient thickness is ensured between the heat radiation recess 44 and the screw holes 47.

Although a screw hole is formed by cutting using a drill or the like, it is generally not possible to form a screw groove with a tip part of the drill. Hence, the depth of the screw hole is larger than the height of a part where the screw groove is provided. Thus, if it is attempted to form a screw hole with a predetermined dimension of a screw groove ensured above a heat radiation recess without providing a build-up portion on a mounting portion, a sufficient thickness cannot be ensured between the heat radiation recess and the screw hole and the screw hole cannot be provided above the heat radiation recess. However, the screw hole 47 is formed in the build-up portion 48 provided on top of the mounting portion 42. Thus, the heat radiation recess 44 and the screw hole 47 can be formed vertically one above the other on the mounting portion 42 while ensuring a sufficient thickness between the heat radiation recess 44 and the screw hole 47. Thus, the mounting portion 42 is not enlarged as compared with the case where the mounting portion and the heat radiation recess are displaced in forward and backward directions.

On the other hand, as shown in FIGS. 6, 10 and 11, a second locking portion 58 is provided on a lower end part of the main body 51 for locking an engaging portion 49 connected to a lower outer peripheral edge part of the embedded portion 41 and opposite lower lateral edges of the mounting portion 42 from below.

The engaging portion 49 is stepped to be raised slightly from the lower surface of the bracket 40 and is recessed slightly inward of the outer peripheral surfaces of the embedded portion 41 and the mounting portion 42.

The second locking portion 58 is formed on an outer peripheral edge of the main body portion 51 except at a front edge part of the main body 51 to correspond to the engaging portion 49, and at least partly covers the engaging portion 49 from below. That is, as shown in FIG. 5, the second locking portion 58 is substantially U-shaped in bottom view and surrounds the embedded portion 41 over substantially the entire circumference together with the first locking portions 57 of the main body portion 51.

Specifically, the first and second locking portions 57, 58 of the main body 51 lock the bracket 40 from below in such a manner as to surround the embedded portion 41 over substantially the entire circumference and reliably prevent the resin portion 50 and the bracket 40 from being separated vertically.

To prevent the separation of a resin portion and a bracket, it is thought to provide a stepped engaging portion over the entire circumference on a lower outer peripheral edge part of the bracket and lock the engaging portion over the entire circumference from below by a locking portion of a main body portion by covering the side surfaces of the bracket and the engaging portion over the entire circumference by the resin portion. However, a heat radiation property of the bracket may be reduced if the outer peripheral surface of the bracket is covered over the entire circumference with resin. Further, a gate mark 46 formed when the bracket 40 is formed by die casting may be left on the rear surface of the mounting portion 42. If that gate mark 46 is covered with resin, the resin portion may be broken, such as due to the formation of cracks from fine edge parts formed on an outer peripheral edge part of the gate mark 46.

However, the mounting portion 42 is exposed from the resin portion 50 according to this embodiment. Thus, the resin portion 50 will not break while a heat radiation property of the bracket 40 is improved.

The busbars B extending from the connection device (such as the inverter) are placed on the upper surfaces (mounting surfaces) of the nuts 20 of the terminal block 10 mounted and fixed to the mounting device (such as the motor case) and, then, the terminals T connected to ends of the enameled wires extending from the mounting device (particularly the motor) are placed on the busbars B.

The busbars B may be displaced slightly in the width direction WD when the busbars B are placed on the nuts 20 from above and in the mounting direction MD. However, the lateral edges of the busbars B contact the oblique surfaces 54A of the guides 54 and the busbars B are guided and placed onto the upper surfaces of the nuts 20. Further, even if the terminals T are displaced slightly in the width direction WD, the lateral edges of the bolt fastening portions T1 of the terminals T contact the oblique surfaces 54A of the guiding portions 54 and the terminals T are guided and placed onto the upper surfaces of the nuts 20 similarly to the busbars B.

Further, in the case of the terminal T, even if the barrel T2 is displaced in the width direction WD due to rotational displacement of the terminal T in the width direction WD, the posture correcting portion 55 contacts the lateral edge of the barrel T2 in the width direction WD so that the posture of the barrel portion T2 in the width direction WD is corrected and the terminal T is placed on the nut 20 in a state where adjacent barrels T2 are blocked by the posture correcting portion 55.

The busbar B and the terminal T can be guided onto the nut 20 by the guiding portion 54 and the posture of the barrel T2 of the terminal T can be corrected by the posture correcting portion 55 when the busbar B and the terminal T are placed on the nut 20. Thus, the terminal T and the busbar B can be placed on the nut 20 while ensuring the creepage distance (insulation distance) between adjacent barrel portions T2.

The posture correcting portion 55 corrects the posture of the terminal T by contacting the barrel T2 of the terminal T, and it is necessary to prevent the posture correcting portion 55 from being inclined in the width direction WD to be broken. It is thought to increase the thickness of the entire posture correcting portion to prevent the inclination of the posture correcting portion. However, if the thickness of the posture correcting portion is increased, the clearance between the posture correcting portion and the barrel becomes smaller and even only a slight displacement of the terminal T in the width direction WD may cause the terminal T to move onto the posture correcting portion, so that operability in mounting the terminal T on the nut 20 is reduced.

However, the projections 56 are provided only on the rear part of each posture correcting portion 55 and a part of the posture correcting portion 55 where the barrel T2 is arranged is thinner. Thus, the barrel T2 easily can be arranged between adjacent posture correcting portions 55 even if the barrel T2 is displaced slightly in the width direction WD. This can improve operability in mounting the terminal T on the nut 20 while ensuring the strength of the posture correcting portion 55 in the width direction WD, as compared with the case where the thickness of the entire posture correcting portion is increased.

The bolt BT then is inserted through the busbar B and the bolt insertion hole T3 of the bolt fastening portion T1 and tightened into the bolt fastening hole 21 of the nut 20.

The terminal T may try to rotate with the bolt BT when tightening the bolt BT into the nut 20. However, the posture correcting portion 55 contacts the barrel T2 in the width direction WD to prevent the terminal T from rotating.

Further, in case of plural terminals T, a distance between adjacent terminals T may become shorter and the creepage distance (insulation distance) cannot be ensured if the bolt insertion hole T3 of the bolt fastening portion T1 is large relative to the bolt BT and the terminal T is displaced slightly backward. However, the projecting portions 56 contact the barrel T2 in the width direction WD and the posture of the terminal T can be corrected to approach the proper posture in which the terminal T is straight in forward and backward directions FBD if the terminal T is displaced backward. This can reliably ensure the creepage distance (insulation distance) between the barrels T2.

When the bolt BT is tightened completely into the bolt fastening hole 21 of the nut 20, the busbar B and the bolt fastening portion T1 are fastened together and electrically connected by the bolt BT and the nut 20.

In the process of tightening the bolt BT into the nut 20, the resin portion 50 is pulled up together with the nut 20 and the bracket 40 fixed to the mounting device (e.g. the motor case) and the resin portion 50 may be separated. However, the first locking portions 57 lock the upper ends 47B of the screw grooves 47A in the screw holes 47 provided on the mounting portion 42 from below on the rear edge of the main body portion 51 of the resin portion 50 and the second locking portion 58 locks the engaging portion 49 from below on the front edge and the opposite widthwise side edges of the bracket 40. Specifically, the first and second locking portions 57, 58 provided on the main body 51 of the resin portion 50 lock the embedded portion 41 from below and surround the embedded portion 41 over substantially the entire circumference. Thus, the bracket 40 and the resin portion 50 cannot separate.

Figure 16:
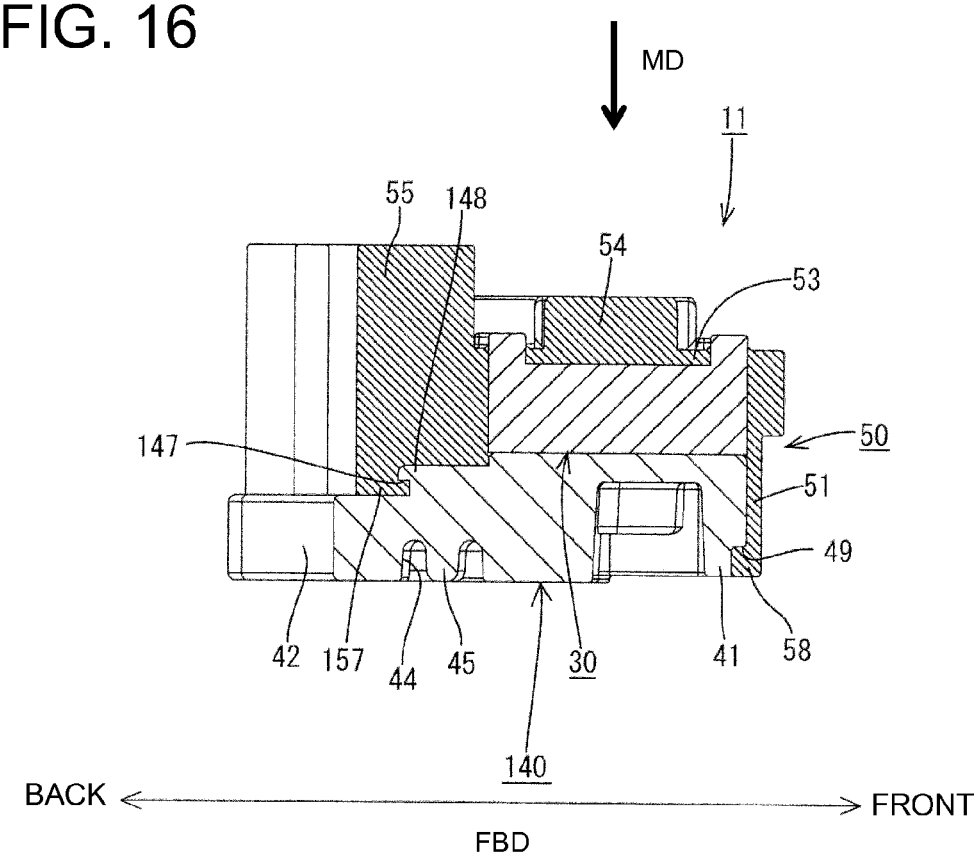
FIG. 16 is a section, equivalent to FIG. 6, in a second embodiment.
Figure 17:
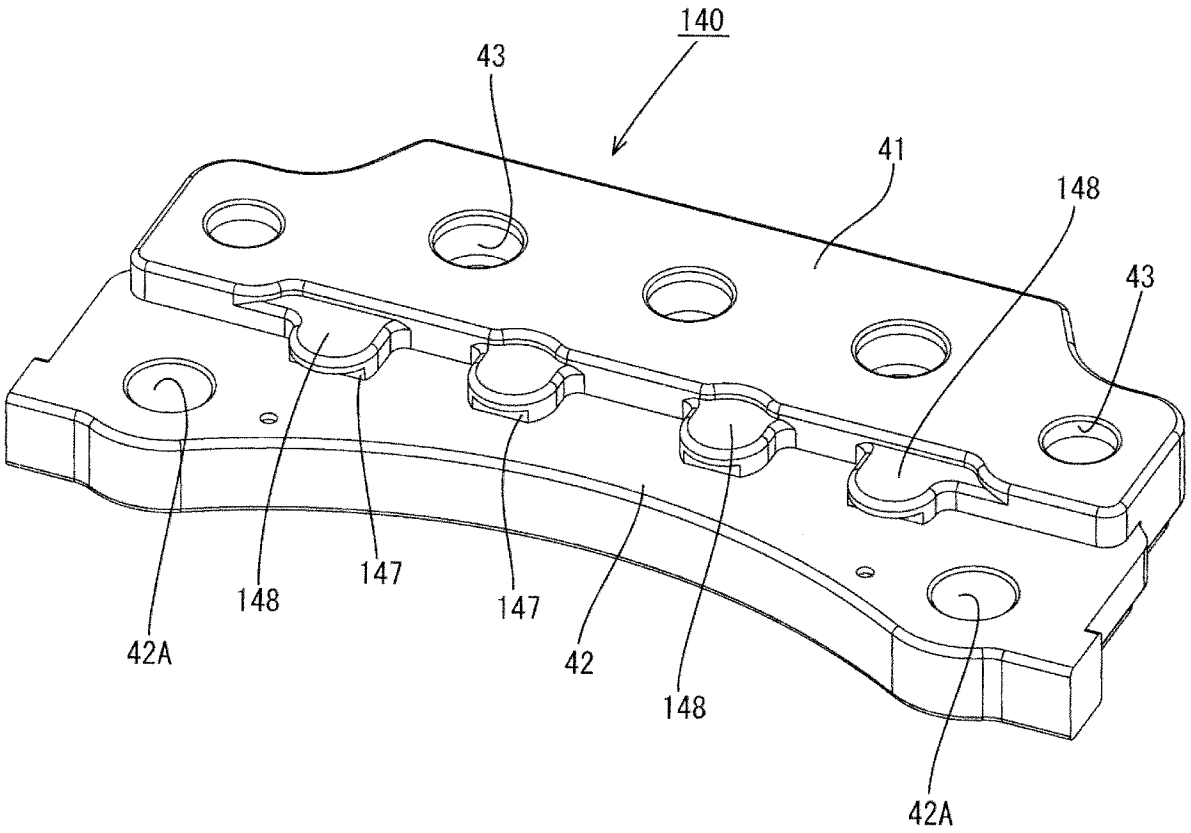
FIG. 17 is a perspective view of a bracket.
Figure 18:
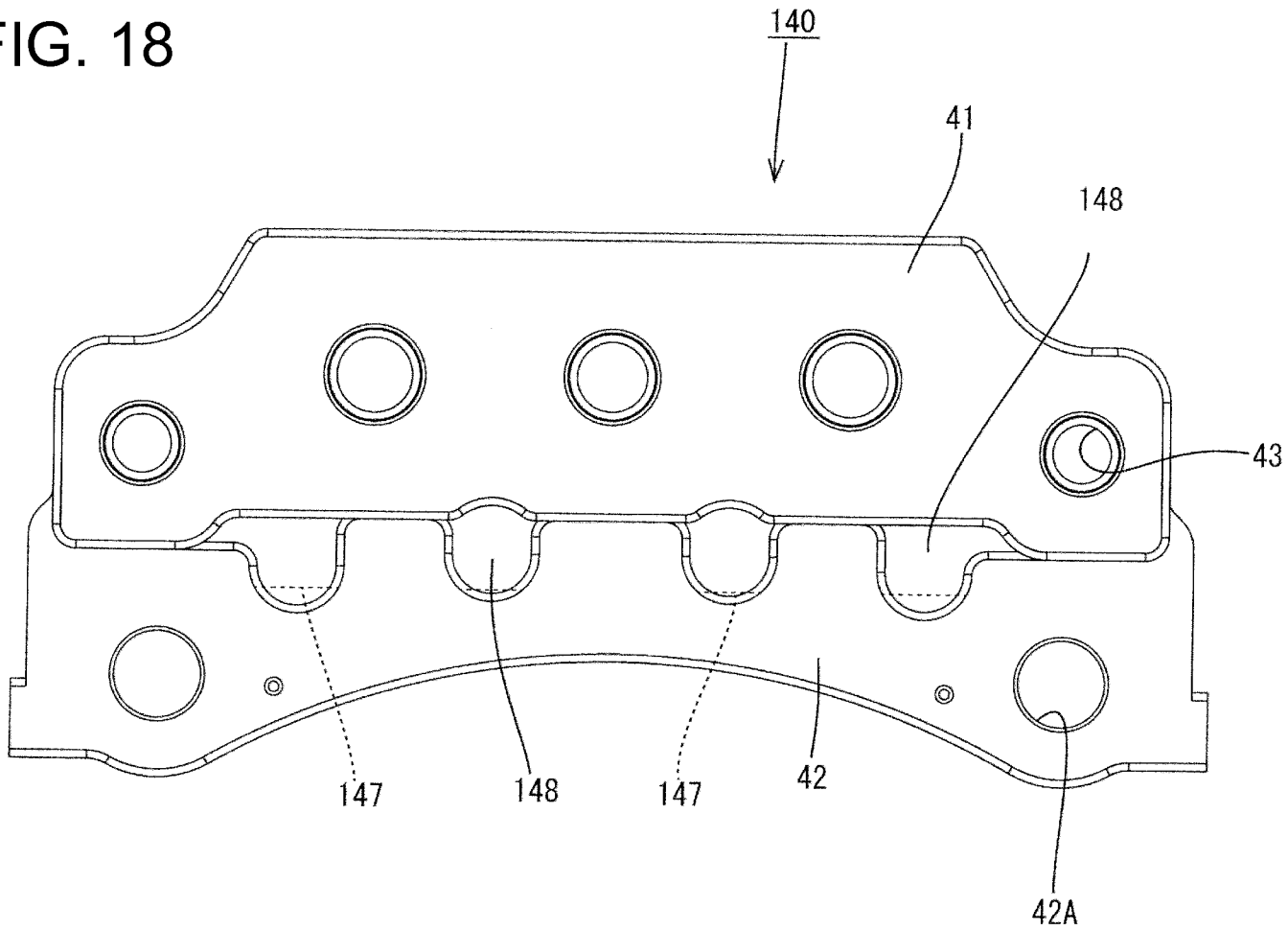
FIG. 18 is a plan view of the bracket.

A second particular embodiment of the present invention is described with reference to FIGS. 16 to 18.

In a terminal block 11 of the second embodiment, the shapes of the build-up portions 48 and the first locking portions 57 of the first embodiment are changed. Configurations, functions and effects similar or common to the first embodiment are not repeatedly described. Further, the similar or same components as those of the first embodiment are denoted by the same reference signs.

Build-up portions 148 of a bracket 140 of the second embodiment are provided with one or more cuts 147 extending in the width direction WD instead of the screw holes. The cuts 147 are recessed forward from the rear end surfaces of the build-up portions 148.

On the other hand, first locking portions 157 of the second embodiment cover the build-up portions 148 from above and enter the cuts 147 from behind. When a resin portion 50 is pulled up, the first locking portions 157 lock the cut portions 147 from below.

When forming vertically recessed cuts in build-up portions, it is thought to form the cut portions in the respective build-up portions individually, for example, using a cutting tool such as a drill, but as many cutting processes as the build-up portions are necessary. However, the cuts 147 of this embodiment can be formed in the build-up portions 148 by cutting the build-up portions 148 straight in the width direction, for example, using a cutting tool such as a T-shaped cutter. This can simplify the cutting process as compared with the case where the cuts are cut individually vertically, for example, using a drill or the like.

The invention is not limited to the above described embodiments. For example, the following embodiments also are included in the scope of the invention.

The busbar B and the terminal T are connected electrically in the above embodiments, but terminals may be electrically connected to each other.

Although the coolant of the motor case is circulated in the heat radiation recess 44 in the above embodiments, the present invention is not limited to such a mode. For example, the entire lower surface of the mounting portion may be held in close contact with the motor case to radiate heat of the bracket to the motor case without providing the radiation recess on the lower surface of the mounting portion.

Although the nut has a substantially rectangular plan view in the above embodiments, the present invention is not limited to such a mode. For example, the nut may have a substantially circular or elliptic plan view.

Although the nuts 20 for neutral point are provided on the opposite widthwise sides of the terminal block 10, 11 in the above embodiments, the present invention is not limited to such a mode. For example, the nut for neutral point may be provided only on one side.

What is claimed is:

1. A terminal block for connecting a conductive members extending from a device and a mating conductive member, comprising:

nuts on which the conductive members and the mating conductive members are to be placed and that cooperate with bolts to fasten the respective conductive member and the mating conductive member together;

a bracket made of metal and arranged substantially adjacent to the nuts, the bracket including at least one mounting portion to be fixed directly to a metal case for housing the device and an embedded portion; and a resin portion that integrally fixes the nuts and the bracket by covering parts of the nuts and the embedded portion of the bracket the resin portion including:

a first locking portion for locking a first engaging portion on the mounting portion of the bracket, a second locking portion for locking a second engaging portion on the embedded portion of the bracket, at least one partition wall for partitioning between adjacent ones of the nuts, posture correcting walls aligned with the partition walls and extending perpendicularly from the mounting portion of the bracket, the posture correcting walls being adjacent positions where the conductive members are pulled out from the nuts and configured to correct postures of the conductive members in a width direction by contacting lateral edges of the conductive members, reinforcing projections at ends of the posture correcting walls remote from the partition walls, the reinforcing projections projecting in toward the positions where the conductive members are pulled out and extending from the mounting portion of the bracket to positions on the posture correcting walls remote from the mounting portion of the bracket.

2. The terminal block of claim 1, wherein a plurality of the nuts are arranged substantially in a width direction intersecting with an extending direction of the conductive member.

3. The terminal block of claim 2, wherein the resin portion includes nut locking portions for locking outer peripheral edge parts of the nuts, the at least one partition wall being between adjacent ones of the nut locking portions while being connected to the nut locking portions.

4. The terminal block of claim 3, wherein the first locking portion is provided on an end part of the partition wall.

5. The terminal block of claim 1, wherein the lower surface of the mounting portion fixed to the case is recessed upwardly to form at least one heat radiation recess for radiating heat of the bracket by taking in coolant for cooling the interior of the case.

6. The terminal block of claim 5, wherein the first engaging portion is formed by cutting a built-up portion provided above the heat radiation recess.

7. The terminal block of claim 1, wherein the first engaging portion comprises a screw hole including a screw groove on an inner peripheral surface.

8. The terminal block of claim 1, wherein the posture correcting walls align respectively with the first engaging portions.

9. A terminal block for connecting a conductive member extending from a device and a mating conductive member, comprising:

a fastening seat on which the conductive member and the mating conductive member are to be placed and that fastens the conductive member and the mating conductive member together with a bolt;

a bracket made of metal and arranged adjacent to the fastening seat; and a resin portion that integrally fixes the fastening seat and the bracket by covering a part of the fastening seat together with the bracket, wherein:

the bracket includes at least one mounting portion at least partly exposed from the resin portion and to be directly fixed to a metal case for housing the device, and at least one embedded portion embedded in the resin portion; and the resin portion includes a first locking portion for locking a first engaging portion provided on the mounting portion and a second locking portion for locking a second engaging portion provided on the embedded portion a plurality of the first engaging portions are arranged in a width direction intersecting with an extending direction of the conductive member; and the plurality of first engaging portions include one or more cut portions arranged to substantially coincide in a width direction.

* * * * *